US007310075B2

(12) United States Patent
Yoon et al.

(10) Patent No.: US 7,310,075 B2
(45) Date of Patent: Dec. 18, 2007

(54) PLASMA DISPLAY PANEL AND DRIVING METHOD THEREOF

(75) Inventors: Sung Ju Yoon, Seoul (KR); Sung Chun Choi, Kyonggi-do (KR); Insook Lee, Kyonggi-do (KR)

(73) Assignee: LG Electronics Inc., Seoul (KR)

( * ) Notice: Subject to any disclaimer, the term of this patent is extended or adjusted under 35 U.S.C. 154(b) by 22 days.

(21) Appl. No.: 11/109,692

(22) Filed: Apr. 20, 2005

(65) Prior Publication Data

US 2005/0184931 A1 Aug. 25, 2005

Related U.S. Application Data

(62) Division of application No. 09/996,714, filed on Nov. 30, 2001, now abandoned.

(30) Foreign Application Priority Data

Dec. 28, 2000 (KR) ..... 2000-84713

(51) Int. Cl.
*G09G 3/28* (2006.01)

(52) U.S. Cl. ..... 345/60; 345/66

(58) Field of Classification Search ..... 313/574, 313/582, 584, 586, 633; 315/169.1, 169.4; 345/60, 61–68, 41
See application file for complete search history.

(56) References Cited

U.S. PATENT DOCUMENTS

| | | | | |
|---|---|---|---|---|
| 4,562,434 | A | 12/1985 | Amano | 345/67 |
| 4,665,345 | A * | 5/1987 | Shionoya et al. | 315/169.4 |
| 5,405,494 | A | 4/1995 | Nagano | 216/4 |
| 2001/0024092 | A1 | 9/2001 | Kim et al. | 315/169.4 |
| 2002/0003515 | A1* | 1/2002 | Lee et al. | 345/60 |

FOREIGN PATENT DOCUMENTS

| | | |
|---|---|---|
| KR | 2000-0038273 | * 7/2000 |
| KR | 2000-0047030 | * 8/2000 |
| KR | 2000-0064829 | * 11/2000 |

* cited by examiner

*Primary Examiner*—Nitin I. Patel
(74) *Attorney, Agent, or Firm*—Ked & Associates, LLP

(57) ABSTRACT

A PDP and a driving method thereof are disclosed in which luminous efficiency can be improved. The PDP includes: a pair of sustain electrodes formed at a peripheral portion of an upper substrate; and a trigger electrode formed at the center of the upper substrate.

8 Claims, 6 Drawing Sheets

PLASMA DISPLAY PANEL AND DRIVING METHOD THEREOF

CROSS-REFERENCE TO RELATED APPLICATIONS

This application claims the benefit of the Korean Application No. P2000-84713, filed on Dec. 28, 2000, which is hereby incorporated by reference. This application is a divisional application of U.S. application Ser. No. 09/996,714, filed Nov. 30, 2001. now abandoned

BACKGROUND OF THE INVENTION

1. Field of the Invention

The present invention relates to a plasma display panel (PDP) and a driving method thereof, and more particularly, to a PDP and a driving method thereof that can improve luminous efficiency.

2. Discussion of the Related Art

A PDP is a display device using visible rays generated from a phosphor when vacuum ultraviolet rays generated by gas discharge excite the phosphor. The PDP is thinner and lighter in weight than a cathode ray tube (CRT) that has been mainly used as a display device. The PDP also enables a large sized screen with high definition.

Such a PDP includes a plurality of discharge cells, each cell having one pixel on a screen.

FIG. 1 is a perspective view illustrating a discharge cell of a related art three-electrode alternating current area discharge type PDP.

Referring to FIG. 1, the discharge cell of the related art three-electrode alternating current area discharge type PDP includes a scan/sustain electrode 12Y, a common sustain electrode 12Z, and an address electrode 20X. The scan/sustain electrode 12Y and the common sustain electrode 12Z are formed on an upper substrate 10, and the address electrode 20X is formed on a lower substrate 18.

On the upper substrate 10 on which the scan/sustain electrode 12Y and the common sustain electrode 12Z are formed in parallel, an upper dielectric layer 14 and a passivation film 16 are layered. Wall charges generated by a plasma discharge are accumulated in the upper dielectric layer 14. The passivation film 16 prevents the upper dielectric layer 14 from being damaged due to sputtering generated by the plasma discharge and increases secondary electron emission. MgO is generally used as the passivation film 16.

A lower dielectric layer 22 and a sidewall 24 are formed on the lower substrate 18 on which the address electrode 20X is formed. A phosphor layer 26 is deposited on surfaces of the lower dielectric layer 22 and the sidewall 24.

The address electrode 20X is formed to cross the scan/sustain electrode 12Y and the common sustain electrode 12Z. The sidewall 24 is formed in parallel with the address electrode 20X, so that ultraviolet rays and visible rays generated by a discharge are prevented from leaking out to an adjacent discharge cell. The phosphor layer 26 is excited by the ultraviolet rays generated by the plasma discharge and generates one of red, green, or blue visible rays.

Also, an inert gas for a gas discharge is injected into a discharge space between the upper substrate 10 or the lower substrate 18 and the sidewall 24.

The aforementioned alternating current area discharge type PDP divides one frame into a plurality of sub-fields having different discharge number of times to display gray level of a picture image. Each sub-field includes a reset period for uniformly generating a discharge, an address period for selecting a discharge cell, and a sustain period for displaying gray level in accordance with discharge number of times. For example, if a picture image is displayed in 256 gray levels, a frame period (16.67 ms) corresponding to 1/60 sec. is divided into eight sub-fields. Each of the eight sub-fields is divided into a reset period, an address period, and a sustain period. The reset period has the same value in each sub-field. Likewise, the address period has the same value in each sub-field. However, the sustain period is increased at a rate of $2^n$ (n=0,1,2,3,4,5,6,7) in each sub-field. Since the sustain period is varied in each sub-field, gray level of the picture image can be displayed.

A reset pulse is supplied to the scan/sustain electrode 12Y during the reset period, so that a reset discharge occurs. During the address period, a scan pulse is supplied to the scan/sustain electrode 12Y and a data pulse is supplied to the address electrode 20X so that an address discharge occurs between the electrodes 12Y and 20X. Wall charges are generated in the upper and lower dielectric layers 14 and 22 during the address discharge. During the sustain period, an alternating current signal is alternately supplied to the scan/sustain electrode 12Y and the common sustain electrode 12Z so that a sustain discharge occurs between the electrodes 12Y and 12Z.

However, in the related art alternating current area discharge type PDP, a sustain discharge space is concentrated on the center of the upper substrate 10, thereby reducing applicability of the discharge space. That is, as shown in FIG. 2, since the sustain discharge occurs between the scan/sustain electrode 12Y and the common sustain electrode 12Z formed on the upper substrate 10 at a narrow distance, a discharge area is reduced, thereby reducing luminous efficiency. At this time, if the scan/sustain electrode 12Y and the common sustain electrode 12Z are formed at a wider distance to increase the discharge area, a high driving voltage should be applied to the scan/sustain electrode 12Y and the common sustain electrode 12Z. That is, power consumption is increased for the sustain discharge, thereby reducing driving efficiency of the PDP.

To solve such a problem, a five-electrode alternating current area discharge type PDP as shown in FIG. 3 has been proposed.

FIG. 3 is a perspective view illustrating a discharge cell of another related art five-electrode alternating current area discharge type PDP.

Referring to FIG. 3, the related art five-electrode alternating current area discharge type PDP includes first and second trigger electrodes 34Y and 34Z formed at the center of a discharge cell on an upper substrate 30, a scan/sustain electrode 32Y and a common sustain electrode 32Z formed at a peripheral portion of the discharge cell on the upper substrate 30, and an address electrode 42X formed at the center of the lower substrate 40 to be orthogonal to the trigger electrodes 34Y and 34Z, the scan/sustain electrodes 32Y, and the common sustain electrode 32Z. On the upper substrate 30 on which the scan/sustain electrode 32Y, the first trigger electrode 34Y, the second trigger electrode 34Z, and the common sustain electrode 32Z are formed in parallel, an upper dielectric layer 36 and a passivation film 38 are layered. On the lower substrate 40 on which the address electrode 42X is formed, a lower dielectric layer 44 and a sidewall 46 are formed. A phosphor layer 48 is deposited on surfaces of the lower dielectric layer 44 and the sidewall 46.

An alternating current pulse is supplied to the trigger electrodes 34Y and 34Z formed at the center of the discharge cell at a narrow distance during the sustain period. The trigger electrodes 34Y and 34Z are used to start a sustain discharge. The alternating current pulse is also supplied to the scan/sustain electrode 32Y and the common sustain electrode 32Z formed at a wider distance at the peripheral portion of the discharge cell during the sustain period. The scan/sustain electrode 32Y and the common sustain electrode 32Z are used to start a plasma discharge between the trigger electrodes 34Y and 34Z and to maintain the plasma discharge. To drive the five-electrode alternating current area discharge type PDP, a waveform shown in FIG. 4 is applied.

Referring to FIG. 4, in the related art five-electrode alternating current area discharge type PDP, one frame is divided into various sub-field having different discharge number of times to display gray level of a picture image. Each sub-field includes a reset period for uniformly generating a discharge, an address period for selecting a discharge cell, and a sustain period for displaying gray level in accordance with discharge number of times.

During the reset period, a reset pulse is supplied to the second trigger electrode Tz so that a reset discharge for initiating the discharge cell occurs. At this time, a direct current voltage is supplied to the address electrode X to prevent an error discharge from occurring.

During the address period, scan pulses C are sequentially supplied to the first trigger electrode Ty and data pulses Va synchronized with the scan pulses C are supplied to the address electrode X. At this time, an address discharge occurs in the discharge cell to which the data pulses Va are supplied.

During the sustain period, sustain pulses are alternately applied between the first trigger electrode Ty and the scan/sustain electrode Sy and between the second trigger electrode Tz and the common sustain electrode Sz. At this time, a voltage Vt applied to the trigger electrodes Ty and Tz has a lower level than a voltage Vs applied to the scan/sustain electrode Sy and the common sustain electrode Sz. During the sustain period, a direct current voltage is supplied to the address electrode X to prevent an error discharge from occurring.

A sustain discharge step will be described in more detail with reference to FIG. 5.

First, if the sustain pulse is applied to the first trigger electrode Ty, the scan/sustain electrode Sy, the second trigger electrode Tz, and the common sustain electrode Sz, a trigger discharge occurs between the first trigger electrode Ty and the second trigger electrode Tz. Then, a transition discharge occurs between the second trigger electrode Tz and the common sustain electrode Sz or between the first trigger electrode Ty and the scan/sustain electrode Sy. As a result, the trigger discharge generated between the first trigger electrode Ty and the second trigger electrode Tz is transited to the sustain discharge between the scan/sustain electrode Sy and the common sustain electrode Sz. In other words, the sustain discharge occurs between the scan/sustain electrode Sy and the common sustain electrode Sz after the transition discharge occurs. At this time, even if the distance between the scan/sustain electrode Sy and the common sustain electrode Sz is great, a discharge can occur by means of a sustain pulse having a relatively low voltage level due to priming charged particles generated by the transition discharge. Thus, the sustain discharge having a long discharge path can occur while reducing increase of a sustain voltage.

However, a transition discharge path in the five-electrode alternating current area discharge type PDP is almost half of a sustain discharge path. That is, to generate the transition discharge corresponding to half of the sustain discharge path, a high voltage should be applied to the trigger electrodes Ty and Tz. A strong transition discharge occurs due to the high voltage applied to the trigger electrodes Ty and Tz. Wall charges are generated by the transition discharge and accumulated in a surface of the scan/sustain electrode 12Y or the common sustain electrode 12Z. The wall charges accumulated in the scan/sustain electrode 12Y or the common sustain electrode 12Z cause the sustain discharge contributed to luminance to be weakened, thereby reducing luminous efficiency of the PDP.

SUMMARY OF THE INVENTION

Accordingly, the present invention is directed to a PDP and a driving method thereof that substantially obviates one or more problems due to limitations and disadvantages of the related art.

An object of the present invention is to provide a PDP and a driving method thereof in which luminous efficiency can be improved.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a PDP according to the present invention includes: a pair of sustain electrodes formed at a peripheral portion of an upper substrate; and a trigger electrode formed at the center of the upper substrate.

In another aspect, a method for driving a PDP including a reset period, an address period, and a sustain period, includes the steps of: supplying a reset pulse to a trigger electrode formed at the center of an upper substrate during the reset period; supplying a scan pulse to the trigger electrode during the address period; supplying a data pulse synchronized with the scan pulse to an address electrode formed on a lower substrate opposing the upper substrate during the address period; alternately applying a sustain pulse to a pair of sustain electrodes formed at a peripheral portion of the upper substrate during the sustain period; and applying a trigger pulse to the trigger electrode during the sustain period.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
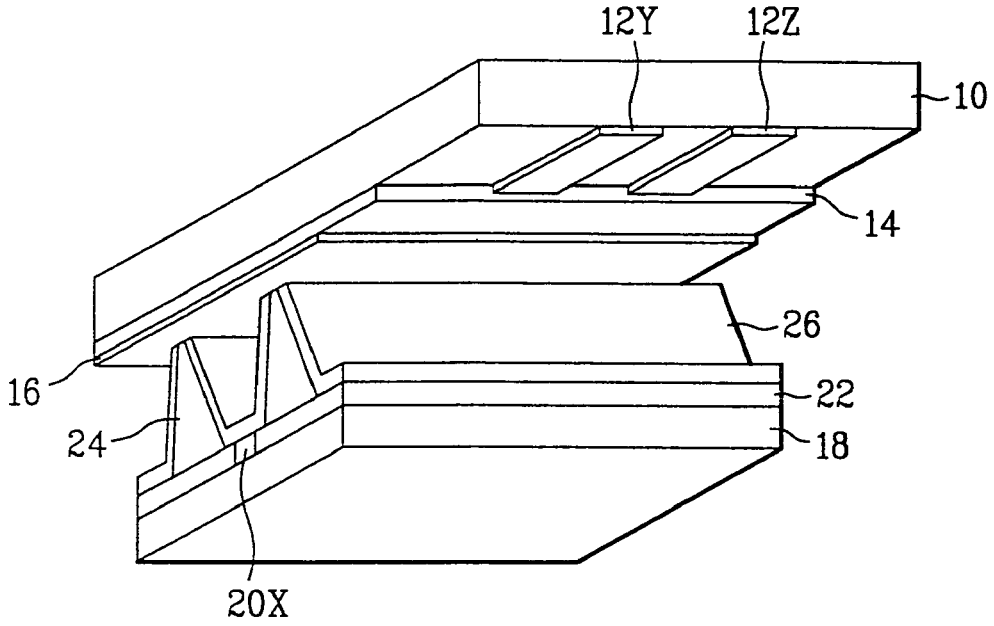
FIG. 1 Background Art
FIG. 1 is a perspective view illustrating a discharge cell of a related art three-electrode PDP.
Figure 2:
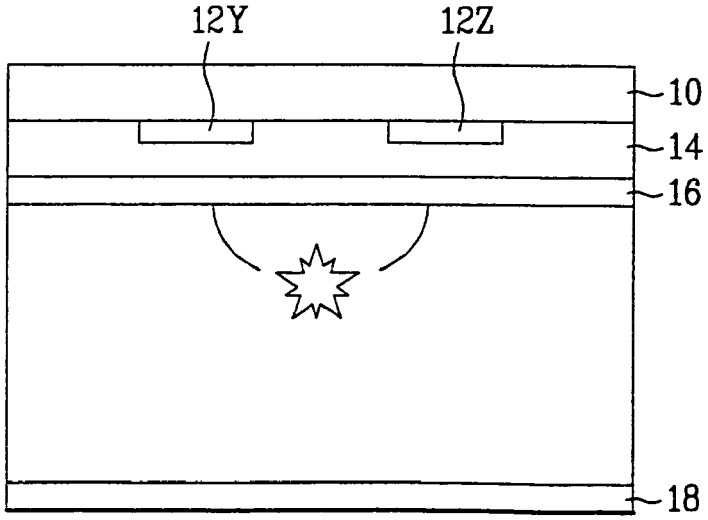
FIG. 2 Background Art
FIG. 2 is a sectional view illustrating a sustain discharge of the PDP shown in FIG. 1.
Figure 3:
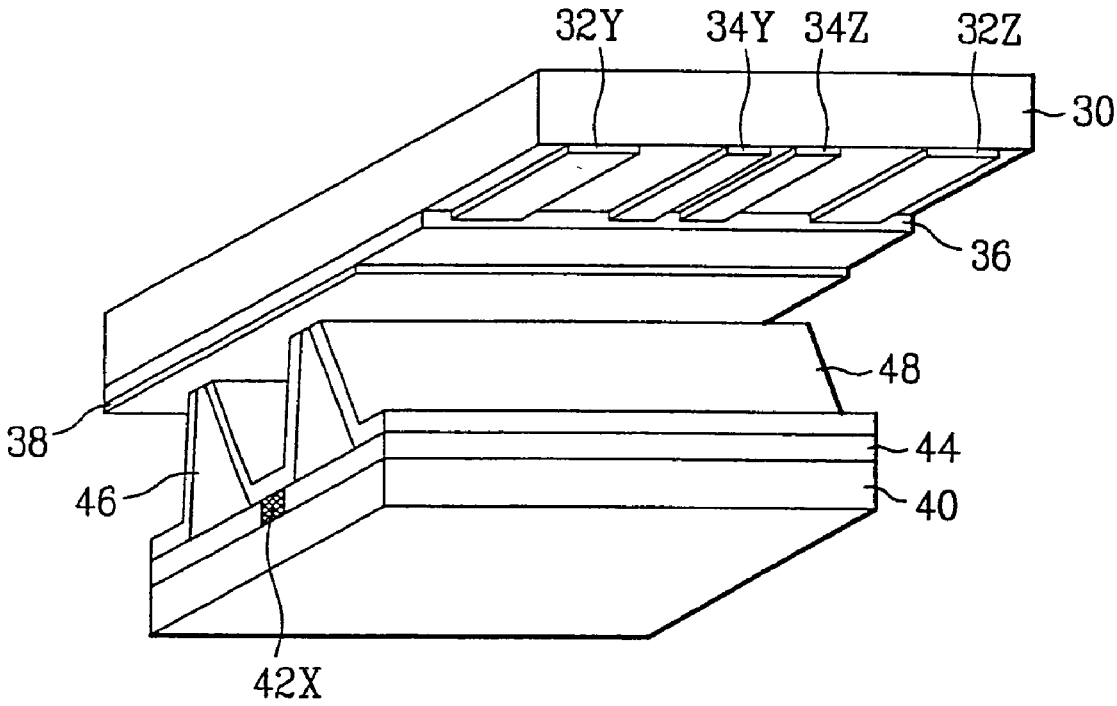
FIG. 3 Background Art
FIG. 3 is a perspective view illustrating a discharge cell of a related art five-electrode PDP.
Figure 4:
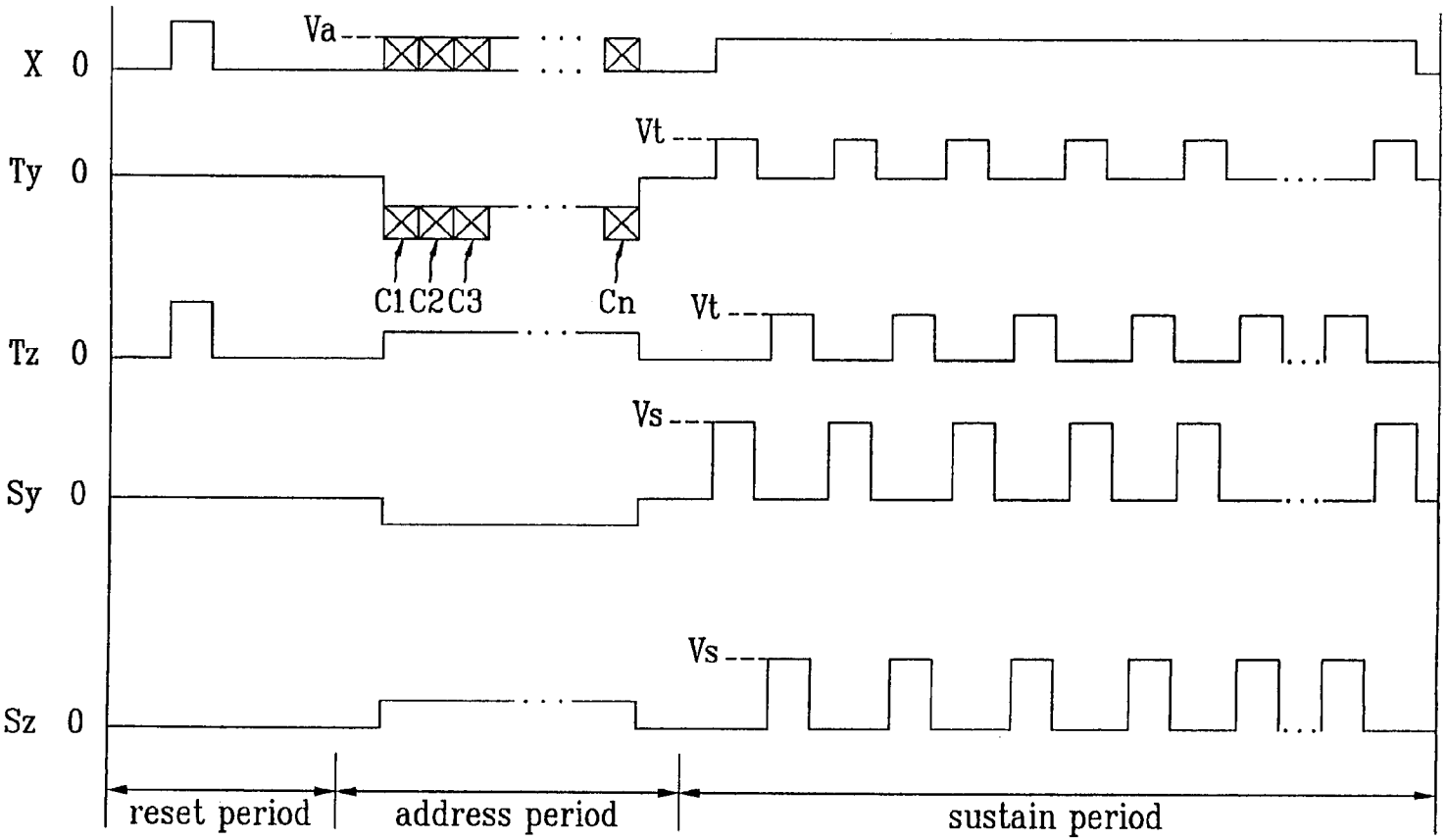
FIG. 4 Background Art
FIG. 4 illustrates a driving waveform applied to the PDP shown in FIG. 3.
Figure 5:
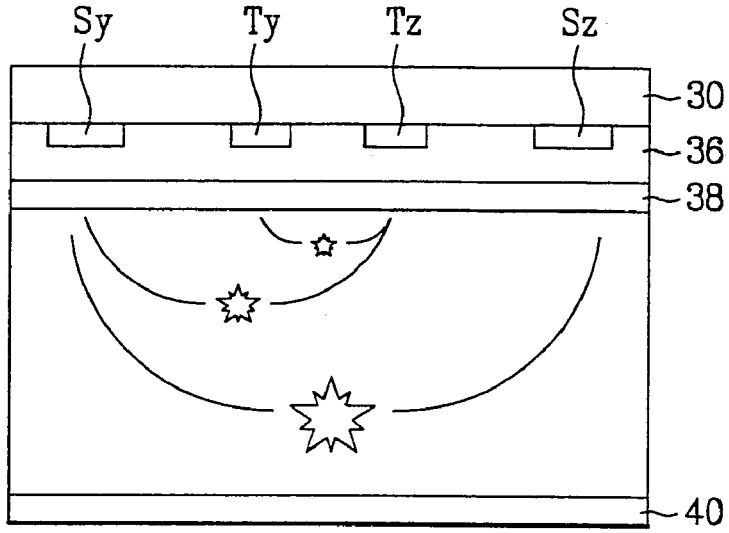
FIG. 5 Background Art
FIG. 5 is a sectional view illustrating a sustain discharge of the PDP shown in FIG. 3.
Figure 6:
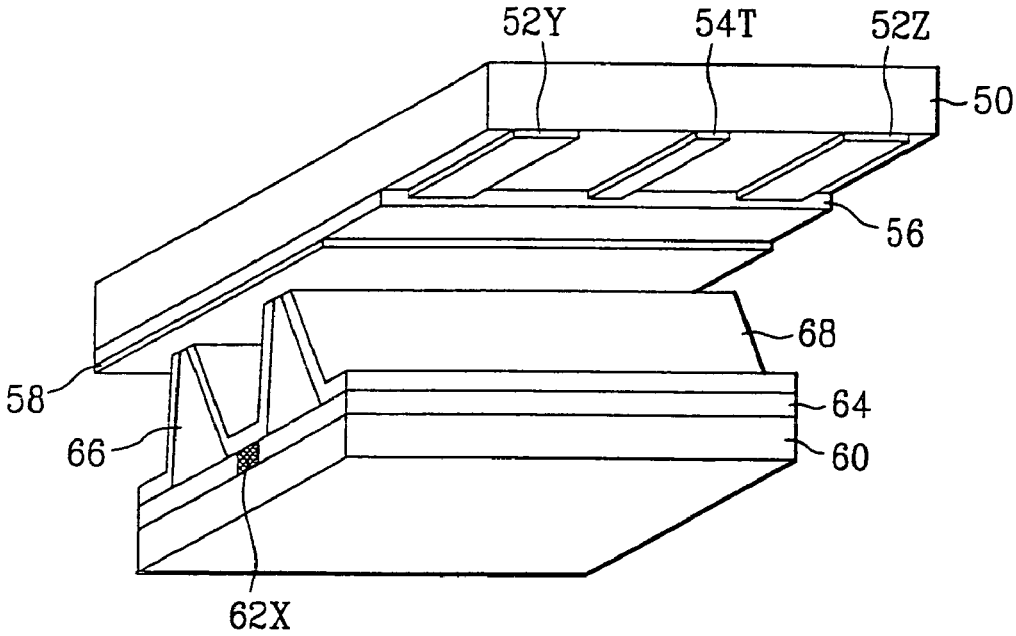
FIG. 6 is a perspective view illustrating a discharge cell of a PDP according to the embodiment of the present invention.

FIG. 6 is a perspective view illustrating a discharge cell of a PDP according to the embodiment of the present invention.

Referring to FIG. 6, the PDP according to the embodiment of the present invention includes a first sustain electrode 52Y and a second sustain electrode 52Z formed at a peripheral portion of a discharge cell on an upper substrate 50, a trigger electrode 54T formed between the first sustain electrode 52Y and the second sustain electrode 52Z, and an address electrode 62X formed at the center of a lower substrate 60 to be orthogonal to the first and second sustain electrodes 52Y and 52Z and the trigger electrode 54T. On the upper substrate 50 on which the trigger electrode 54T and the first and second sustain electrodes 52Y and 52Z are formed in parallel, an upper dielectric layer 56 and a passivation film 58 are layered. On the lower substrate 60 on which the address electrode 62X is formed, a lower dielectric layer 64 and a sidewall 66 are formed. A phosphor layer 68 is deposited on surfaces of the lower dielectric layer 64 and the sidewall 66.

The trigger electrode 54T is disposed to be adjacent to the first and second sustain electrodes 52Y and 52Z. An alternating current pulse is supplied to the trigger electrode 54T during a sustain period, so that a trigger discharge occurs between the trigger electrode 54T and the first sustain electrode 52Y or the second sustain electrode 52Z. The first and second sustain electrodes 52Y and 52Z are used to maintain a plasma discharge after the trigger discharge is started.

In the PDP according to the embodiment of the present invention, one frame is divided into various sub-fields having different discharge number of times to display gray level of a picture image. Each sub-field includes a reset period for uniformly generating a discharge, an address period for selecting a discharge cell, and a sustain period for displaying gray level in accordance with discharge number of times.

During the reset period, a reset pulse is supplied to the trigger electrode 54T so that a reset discharge for initiating the discharge cell occurs. At this time, a direct current voltage is supplied to the address electrode 62X to prevent an error discharge from occurring.

During the address period, scan pulses are sequentially supplied to the trigger electrode 54T, and data pulses synchronized with the scan pulses are supplied to the address electrode 62X. At this time, an address discharge occurs in the discharge cell to which the data pulses are supplied. Meanwhile, the scan pulses may be applied to the first sustain electrode 52Y or the second sustain electrode 52Z along with the trigger electrode 54T.

During the sustain period, a trigger pulse is supplied to the trigger electrode 54T and sustain pulses are supplied to the first and second sustain electrodes 52Y and 52Z.

Figure 7:
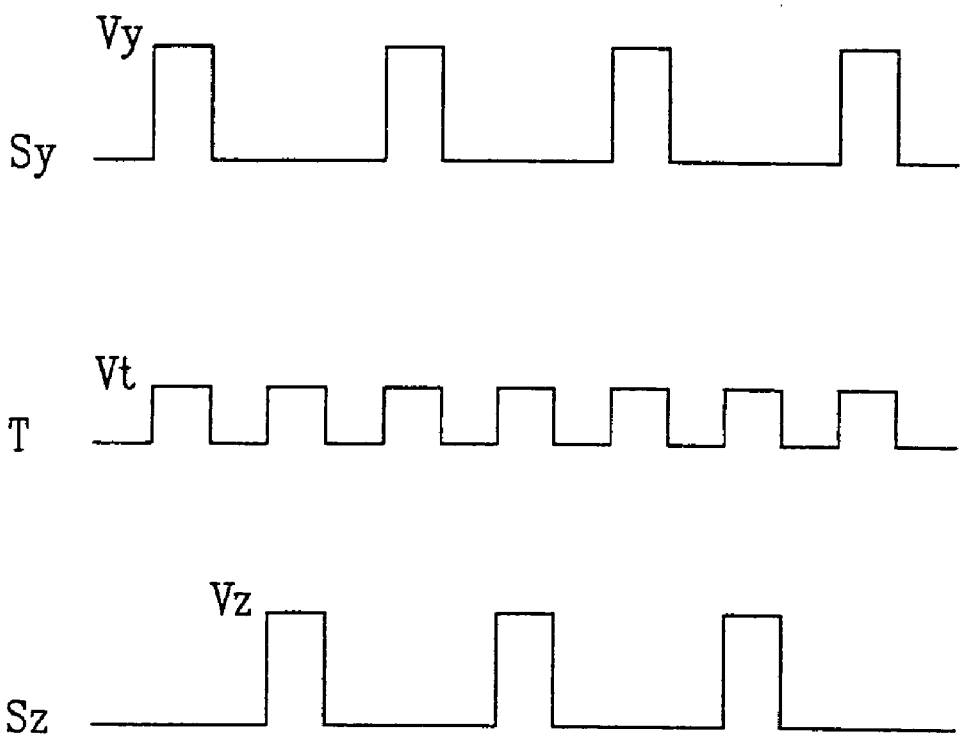
FIG. 7 illustrates a driving waveform applied to the PDP shown in FIG. 6 during a sustain period.

FIG. 7 is a waveform of the sustain pulses applied to the respective electrodes 52Y, 52Z and 54T during the sustain period.

Referring to FIG. 7, the sustain pulses are alternately supplied to the first sustain electrode Sy and the second sustain electrode Sz. When the sustain pulses are supplied to the first and second sustain electrodes Sy and Sz, a trigger pulse having a frequency higher two times than the sustain pulses is supplied to the trigger electrode T. The trigger pulse is synchronized with the sustain pulses applied to the first and second sustain electrodes Sy and Sz and then is applied to the trigger electrode T. At this time, voltages Vy and Vz of the sustain pulses applied to the first and second sustain electrodes Sy and Sz are equal to each other. While a voltage Vt of the trigger pulse T applied to the trigger electrode T has a lower level than the voltages Vy and Vz of the sustain pulses.

Figure 8A:
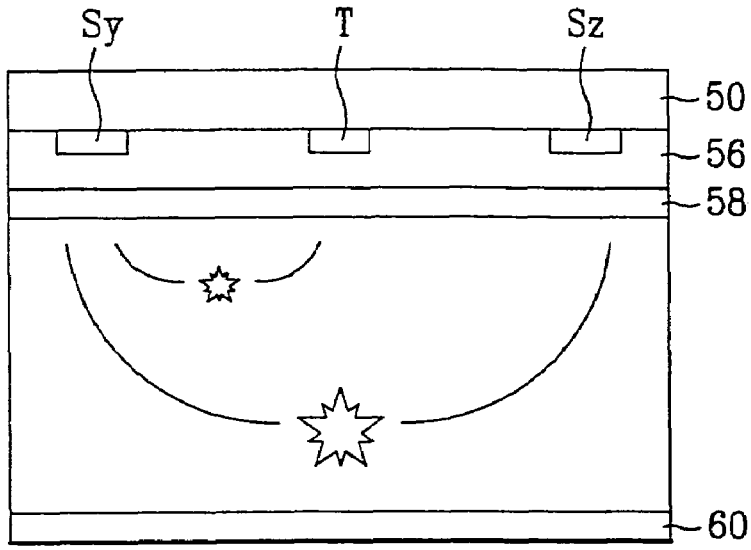
FIGS. 8*a* and 8*b* are sectional views illustrating a sustain discharge generated by the driving waveform shown in FIG. 7.
Figure 8B:
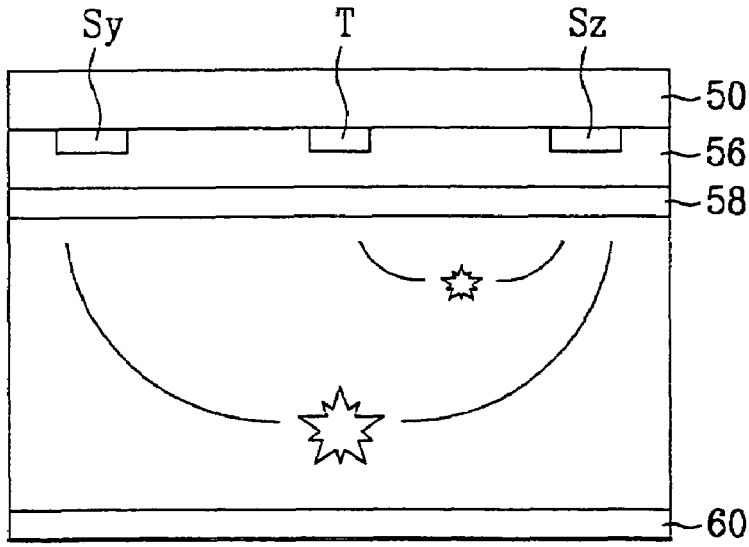

If the sustain pulses and the trigger pulse are applied as above, a trigger discharge occurs between the first sustain electrode Sy and the trigger electrode T or between the second sustain electrode Sz and the trigger electrode T, as shown in FIGS. 8*a* and 8*b*. At this time, the trigger discharge occurs only in discharge cells selected by an address discharge. Meanwhile, since the trigger pulse applied to the trigger electrode T has a lower voltage level than the sustain pulses, a weak trigger discharge occurs. Once the trigger discharge occurs between the first sustain electrode Sy and the trigger electrode or between the second sustain electrode Sz and the trigger electrode T, charged particles are generated. Subsequently, a secondary discharge between the first sustain electrode Sy and the second sustain electrode Sz is caused by priming effect of the generated charged particles. In other words, in the present invention, the sustain discharge can be generated by only the trigger discharge which is a fine discharge. Therefore, a transition discharge can be omitted, and thus discharge efficiency can be improved.

As described above, the PDP and the driving method thereof according to the present invention have the following advantages.

One trigger electrode is formed between a pair of the sustain electrodes. The trigger pulse having a frequency higher two times than that of the sustain pulse is applied to the trigger electrode. The trigger discharge occurs between one of the pair of the sustain electrodes and the trigger electrode. Therefore, in the present invention, the sustain discharge can be generated by the trigger discharge only. Also, the trigger pulse having a lower voltage level than the sustain pulse is applied, the trigger discharge occurs feebly. That is, a long discharge path can be obtained by a lower voltage than a voltage with no trigger discharge, thereby improving luminous efficiency of the PDP.

It will be apparent to those skilled in the art than various modifications and variations can be made in the present invention. Thus, it is intended that the present invention covers the modifications and variations of this invention provided they come within the scope of the appended claims and their equivalents.

What is claimed is:

1. A method for driving a Plasma Display Panel (PDP), comprising:

alternately applying a sustain pulse to a pair of electrodes during a sustain period; and applying a trigger pulse having different frequency and/or voltage level from the sustain pulse to a trigger electrode during the sustain period such that a trigger discharge is generated between the trigger electrode and each of the pair of sustain electrodes alternately.

2. The method of claim 1, wherein the trigger pulse has a higher frequency than that of the sustain pulse.

3. The method of claim 2, wherein the trigger pulse has a frequency higher about two times than that of the sustain pulse.

4. The method of claim 1, wherein the trigger pulse is synchronized with the sustain pulse applied to the pair of the electrodes and then is supplied to the trigger electrode.

5. The method of claim 1, wherein the trigger pulse has a lower voltage level than the sustain pulse.

6. The method of claim 1, wherein one of the pair of electrodes is a scan/sustain electrode and the other is a common electrode.

7. The method of claim 1, wherein the trigger electrode is formed at an equal distance from each of the pair of sustain electrodes.

8. A method for driving a Plasma Display Panel (PDP), comprising:

alternately applying a sustain pulse to a pair of sustain electrodes during a sustain period; and applying a trigger pulse having different frequency and/or voltage level from the sustain pulse to a trigger electrode arranged between the pair of sustain electrodes during the sustain period such that a trigger discharge is generated between the trigger electrode and each of the pair of sustain electrodes alternately.

* * * * *